US008322678B2

(12) United States Patent
Zhu et al.

(10) Patent No.: US 8,322,678 B2
(45) Date of Patent: Dec. 4, 2012

(54) GROUND SPIKE

(75) Inventors: Jianzhong Zhu, Suzhou (CN); Simon Walker, Surrey (CA)

(73) Assignee: Peak Innovations Inc., Richmond (CA)

( * ) Notice: Subject to any disclaimer, the term of this patent is extended or adjusted under 35 U.S.C. 154(b) by 483 days.

(21) Appl. No.: 12/445,276

(22) PCT Filed: Oct. 11, 2007

(86) PCT No.: PCT/CA2007/001814

§ 371 (c)(1),
(2), (4) Date: Apr. 10, 2009

(87) PCT Pub. No.: WO2008/046200

PCT Pub. Date: Apr. 24, 2008

(65) Prior Publication Data

US 2009/0313916 A1 Dec. 24, 2009

(30) Foreign Application Priority Data

Oct. 11, 2006 (CA) ..... 2563135
Jan. 16, 2007 (CA) ..... 2573995

(51) Int. Cl.
*F16M 13/00* (2006.01)

(52) U.S. Cl. ..... 248/530; 248/156; 248/516

(58) Field of Classification Search ..... 248/516, 248/156, 530, 532; 52/165, 726.4
See application file for complete search history.

(56) References Cited

U.S. PATENT DOCUMENTS

| | | | | |
|---|---|---|---|---|
| 4,249,715 | A | 2/1981 | Repp | |
| 4,588,157 | A | 5/1986 | Mills | |
| 4,651,399 | A | 3/1987 | Moraly | |
| 4,874,149 | A | 10/1989 | Miceli | |
| D316,367 | S | 4/1991 | Olson | |
| 5,090,656 | A | 2/1992 | Brown | |
| D325,870 | S | 5/1992 | Niles | |
| 5,230,187 | A | 7/1993 | Reimann | |
| 5,287,671 | A | 2/1994 | Ueki | |
| D349,434 | S | 8/1994 | Archambeau | |
| 5,456,441 | A | 10/1995 | Callies | |
| 5,632,464 | A * | 5/1997 | Aberle | 248/530 |
| 5,927,677 | A * | 7/1999 | Speece et al. | 248/516 |
| 6,039,298 | A | 3/2000 | Steir | |
| 6,273,390 | B1 | 8/2001 | Meyer | |
| 7,219,872 | B2 | 5/2007 | Walker | |
| D579,585 | S * | 10/2008 | Walker et al. | D25/131 |
| 2005/0279896 | A1 * | 12/2005 | Callies | 248/218.4 |

FOREIGN PATENT DOCUMENTS

| | | | |
|---|---|---|---|
| EP | 0144870 | A2 | 6/1985 |
| EP | 0657604 | B1 | 10/1994 |
| GB | 1461802 | | 1/1977 |
| GB | 2140839 | A | 12/1984 |
| GB | 2151273 | A | 7/1985 |
| GB | 2152550 | A | 8/1985 |

(Continued)

*Primary Examiner* — Amy J Sterling

(74) *Attorney, Agent, or Firm* — Smiths IP

(57) ABSTRACT

A metal post support ground spike is disclosed having a post receiving socket, and a flat plate. The flat plate is welded to four walls of the post receiving socket. The post support may also comprise a blades portion welded to the flat plate. The blades portion, post receiving socket and flat plate may all have reinforcement lines stamped therein and may comprise metals of varying thickness and rigidity. The flat plate may comprise the thickest and most rigid metal, whereas the post receiving socket and/or the blades may be made from a thinner and/or less rigid metal.

24 Claims, 16 Drawing Sheets

FOREIGN PATENT DOCUMENTS

| | | | |
|---|---|---|---|
| GB | 2153403 | A | 8/1985 |
| GB | 2195373 | A | 4/1988 |
| GB | 2207451 | A | 2/1989 |
| GB | 2225038 | A | 5/1990 |
| GB | 2268523 | A | 7/1992 |
| GB | 2284435 | A | 12/1993 |
| GB | 2277754 | A | 11/1994 |
| GB | 2283994 | A | 5/1995 |
| GB | 2295628 | A | 6/1996 |
| GB | 2322877 | A | 3/1997 |
| GB | 2355996 | A | 11/1999 |
| GB | 2360301 | B | 6/2003 |
| NZ | 242387 | | 5/1994 |

* cited by examiner

GROUND SPIKE

REFERENCE TO RELATED APPLICATIONS

This application claims priority from Canadian patent application No. 2,563,135 filed Oct. 11, 2006 and Canadian patent application No. 2,573,995 filed Jan. 16, 2007.

FIELD OF THE INVENTION

This invention relates to supporting and firmly anchoring vertical posts, such as fence posts and mailbox posts, in the ground.

BACKGROUND OF THE INVENTION

When installing a vertical post, such as a fence post, it is common to support the post in the ground by one of: (1) burying one end of the post in a hole dug in the ground; (2) filling the area around the base of the post with concrete; or (3) securing the post to a ground spike post support that, in turn, is secured into the ground.

Burying one end of the post in the ground is often unsatisfactory for various reasons, including that digging out a suitable hole and burying the post may be difficult and the ground may not provide suitable support. This may result in a wobbly post that is not well suited for anchoring a fence or the like.

Filling the area around the base of the post with concrete has its own limitations. This requires digging suitable holes around each post, acquiring sufficient concrete to set each post, mixing concrete, pouring concrete into holes around each post, and ensuring that the post is held straight while the concrete sets.

Securing posts to post support means, such as metal ground spikes, is a relatively easy and cost efficient alternative for securing a post to the ground.

Metal ground spikes of varying shapes have been used to secure posts to the ground. U.S. Pat. No. 4,271,646 to Mills discloses a prior art metal post support (2) having a ground engaging blade portion (4) and a post supporting hollow box portion (6) as shown in FIG. 1. Mills discloses four blades (8) disposed in a cross-shaped cross-section, meeting at a central joint (10). Each of the four blades (8) is welded to a flat plate (16), which in turn is welded onto the sides (12) of the hollow box portion (6). The Mills post support is made of mild steel plate of one-eight inch thickness (3.2 mm). To allow drainage of water entering the box-section, drain holes may be drilled in the plate (16). To secure a post to the Mills post support, holes may drilled in the sides (12), through which bolts can be inserted.

A second common ground spike (20) is illustrated in FIGS. 3-8. The common ground spike (20) has a blade portion (21) comprising four blades (22), and a post socket portion (30). The blade portion is made by cutting two pieces of metal as shown in FIG. 4, then bending the two halves of each piece (22A & 22B or 22C & 22D) of the metal into a perpendicular arrangement along a longitudinal fold line (23 or 24). The two pieces of metal are then attached along the respective fold lines (23 & 24) by a welded connection (25).

The post socket portion (30) is made from a unitary piece of metal that is cut in the shape shown in FIG. 7. Three perpendicular bends (along lines 32) form four walls (31) to the post socket (30). Perpendicular bends (along lines 34) enable base tabs (35) to form a partially closed lower surface of the post socket (30). Clamping tabs (36) are formed in one corner of the post socket (30) by additional bends (along lines 33) in the metal. Apertures (38) for bolt connectors appear in the clamping tabs (36).

The blade portion (21) is attached to the post socket portion (30) by welding between the top of each blade (22) and the lower face of the base tabs (35).

The blade portion (21) and post socket portion (30) of the common ground spike (20) are typically made of the same metal material, often having a thickness of between 2.5 mm and 3.5 mm. Mills discloses use of steel having a thickness of one-eighth inch (3.2 mm). The cost of the metal starting material is a major component of the cost of producing a ground spike. Reducing the thickness of metal for the prior art ground spikes cause premature deformations and failures under normal to heavy wear conditions.

There exists a need for a stronger, improved ground spike design, preferably that requires less metal such that it can be manufactured for a lower cost without sacrificing product quality.

BRIEF DESCRIPTION OF THE DRAWINGS

The invention will be described by reference to the detailed description of the invention and to the drawings thereof in which.

DETAILED DESCRIPTION OF THE INVENTION

Throughout the following description specific details are set out to provide a more thorough understanding of the invention. However, the invention may be practiced without these particulars. In other instances, well known elements have not been shown or described in detail to avoid unnecessarily obscuring the present invention. Accordingly, the description and drawings are to be regarded in an illustrative, rather than a restrictive, sense.

Figure 1:
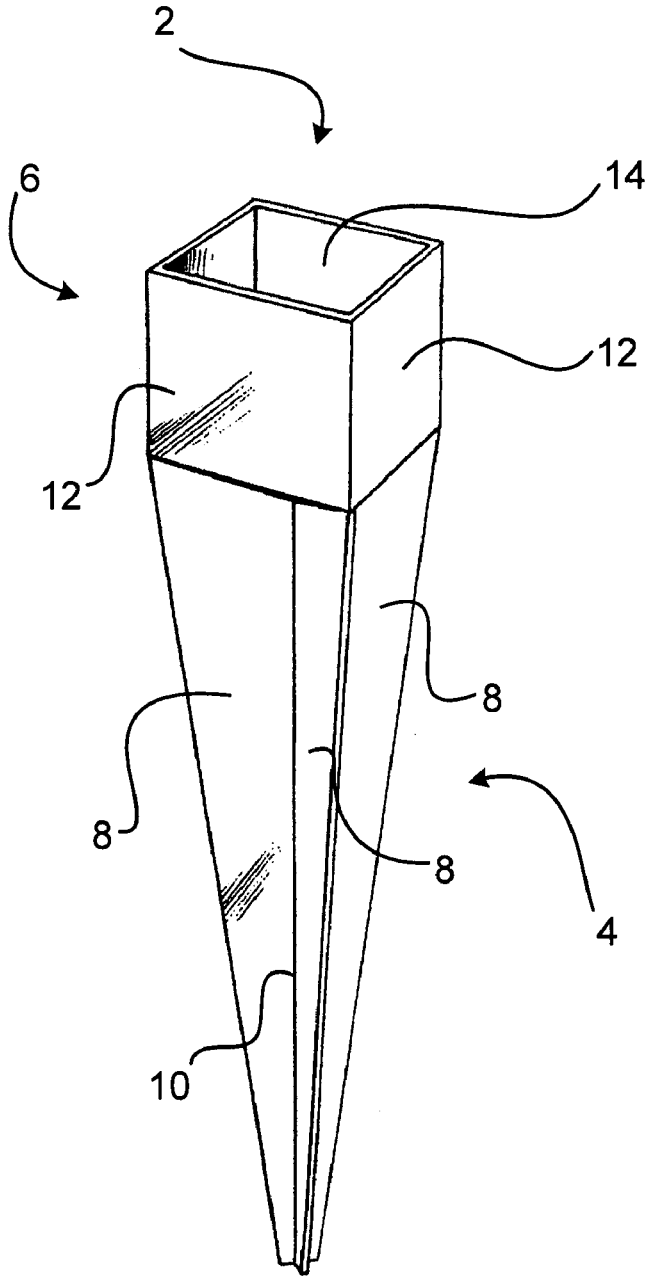
Fig. 1 (Prior Art)
FIG. 1 is a perspective view of a first prior art post support.
Figure 2:
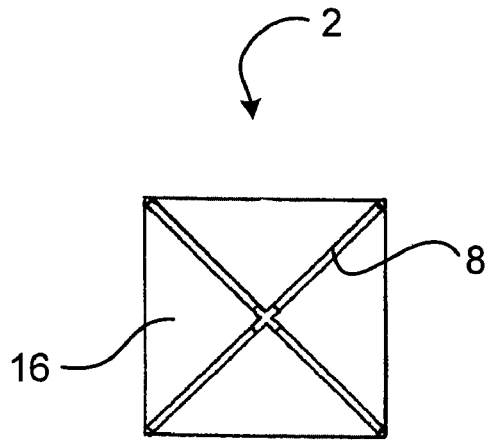
Fig. 2 (Prior Art)
FIG. 2 is a bottom plan view of the first prior art post support.
Figure 3:
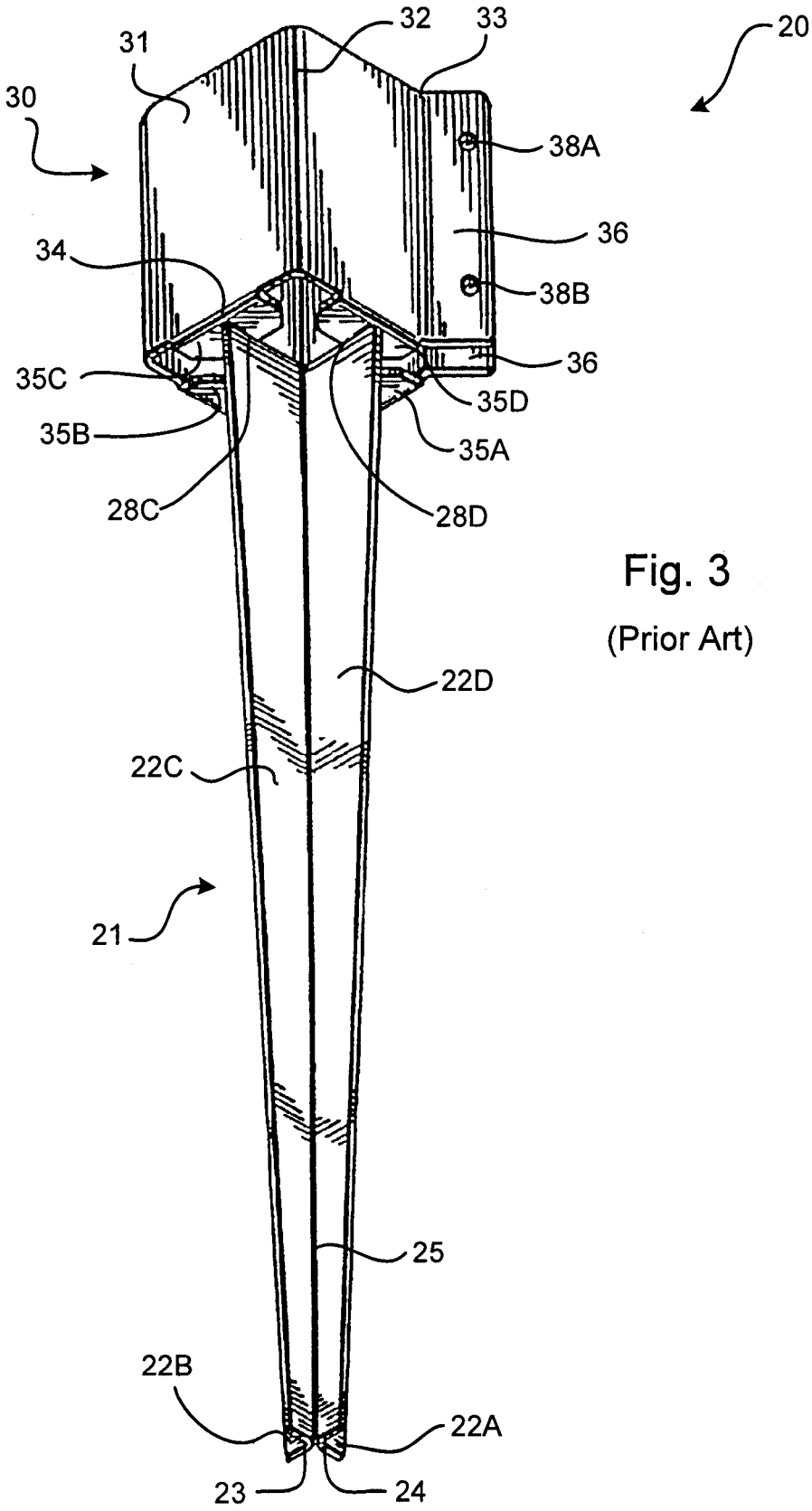
Fig. 3 (Prior Art)
FIG. 3 is a perspective view of a second prior art post support.
Figure 4:
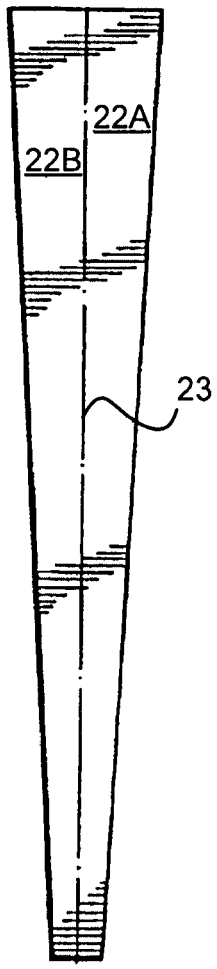
Fig. 4 (Prior Art)
FIG. 4 is a plan view of a segment of a blade portion used in the construction of the second prior art post support.
Figure 5:
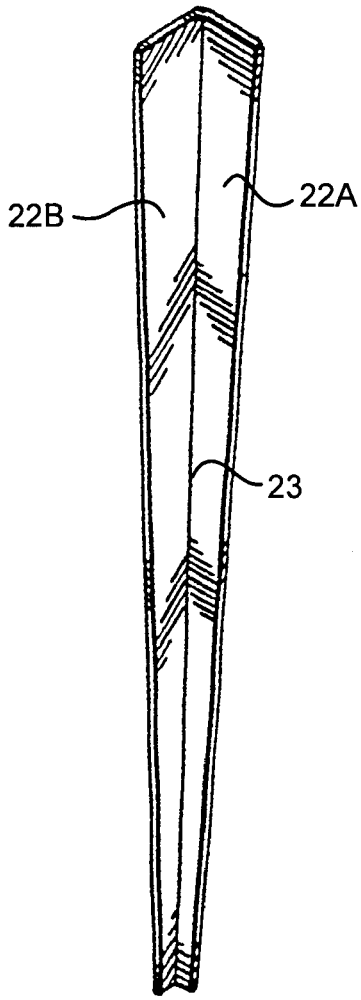
Fig. 5 (Prior Art)
FIG. 5 is a perspective view of a bent segment of the blade portion used in the construction of the second prior art post support.
Figure 6:
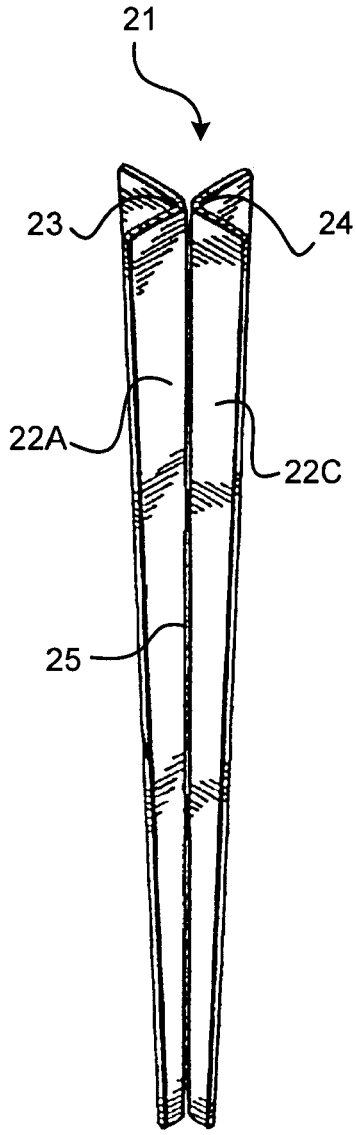
Fig. 6 (Prior Art)
FIG. 6 is a perspective view of the blade portion used in the construction of the second prior art post support.
Figure 7:
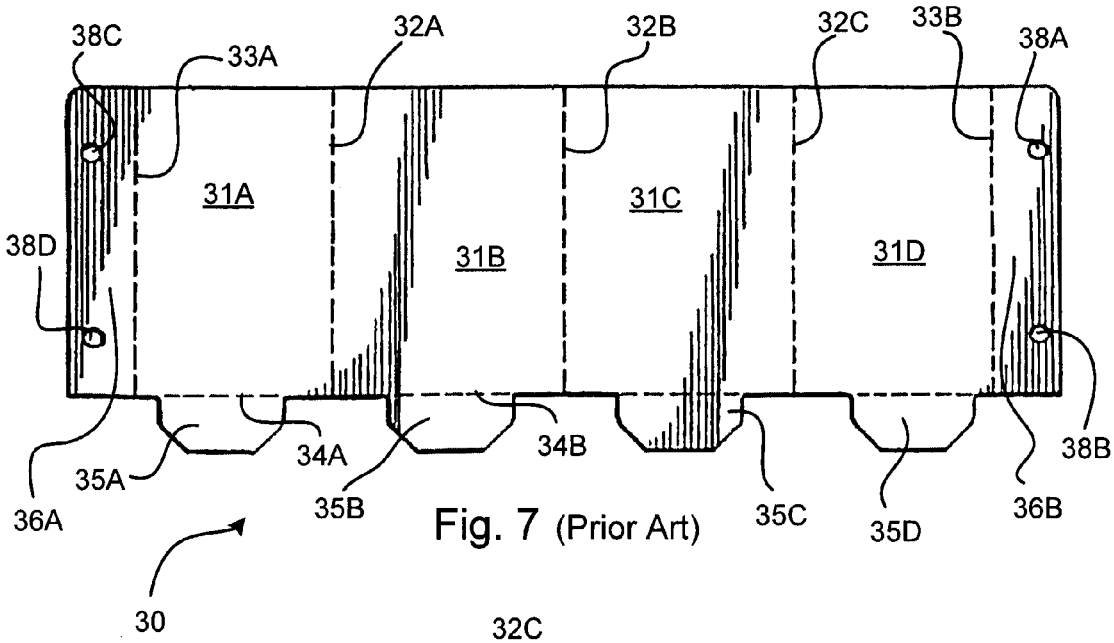
Fig. 7 (Prior Art)
FIG. 7 is a plan view of the starting material used in the construction of a socket portion of the second prior art post support.
Figure 8:
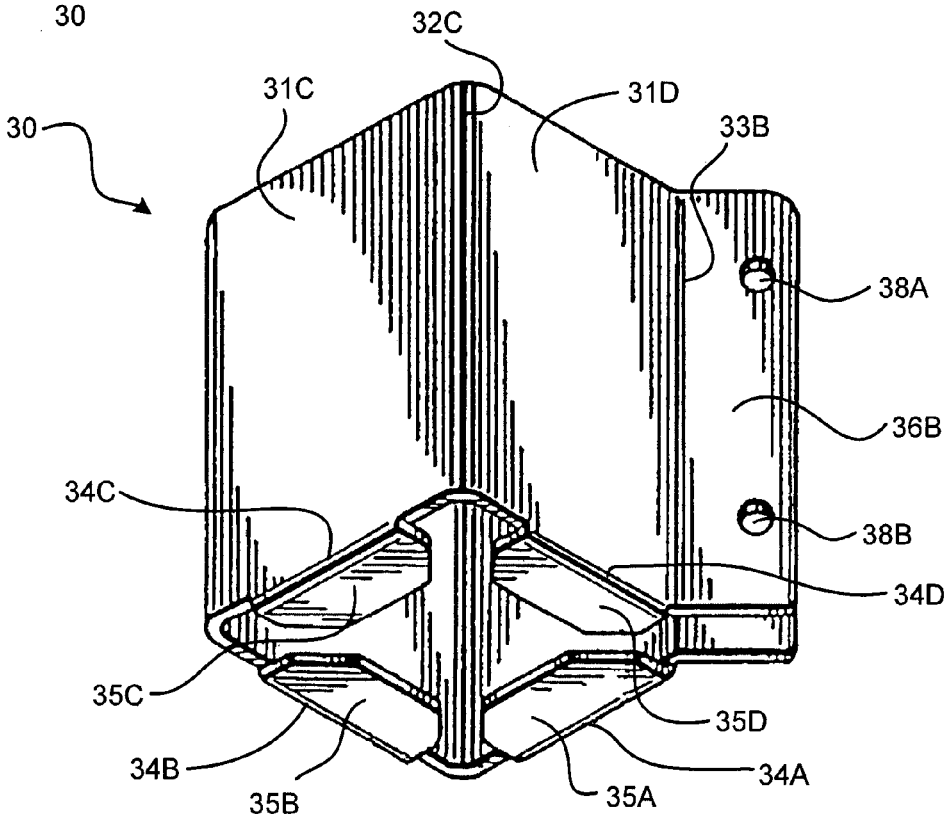
Fig. 8 (Prior Art)
FIG. 8 is a perspective view of the socket portion of the second prior art post support.
Figure 9:
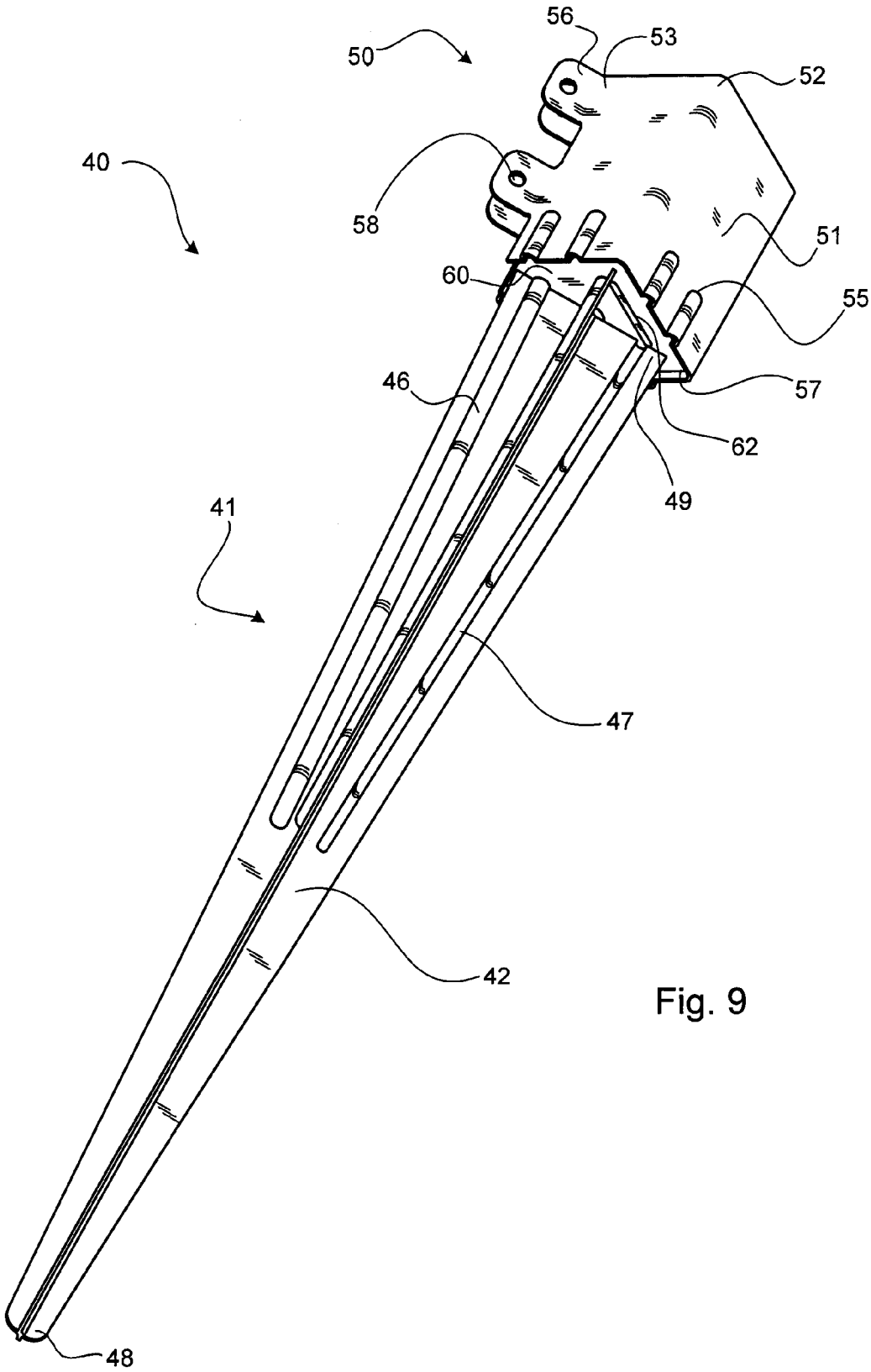
FIG. 9 is a perspective view of a first embodiment of the invention.

With reference to FIG. 9 and subsequent figures, embodiment 40 comprises a ground engaging blade portion 41, a post receiving socket portion 50, and a socket base plate 60. The blade portion 41 comprises a plurality of blades 42 designed for driving into the ground. In embodiment 40, there are four blades 42, though alternate embodiments may have two, three, five, six or more blades. The blades may be reinforced by stamping or otherwise marking reinforcement lines 46, 47 into the blades. Each reinforcement line has a convex portion 46 on one side of the blade and a corresponding concave portion 47 on the other side of the blade.

Figure 10:
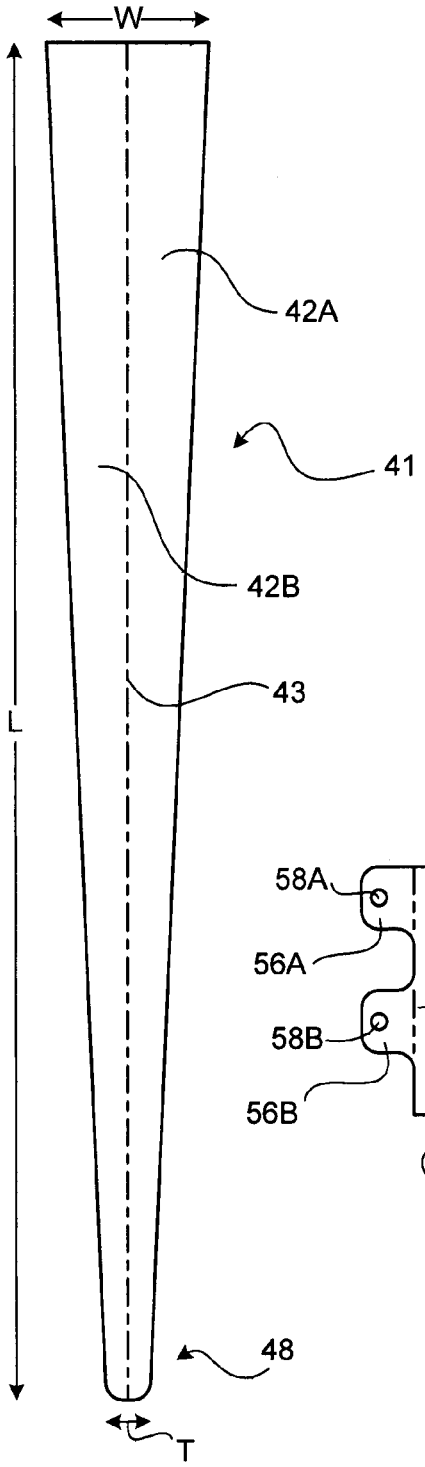
FIG. 10 is a plan view of a segment of a blade portion used in the construction of the first embodiment of the invention.
Figure 12:
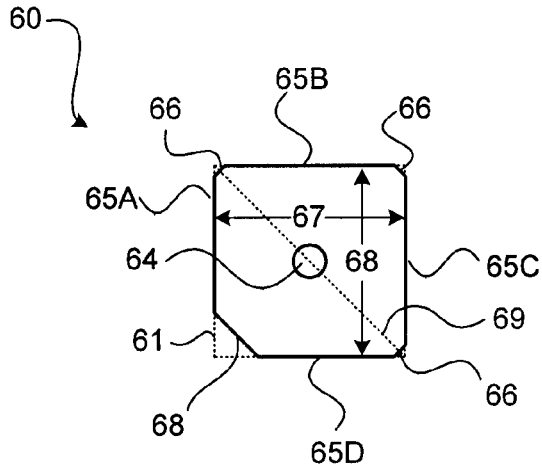
FIG. 12 is a plan view of the starting material used in the construction of a base plate of the first embodiment of the invention.
Figure 11:
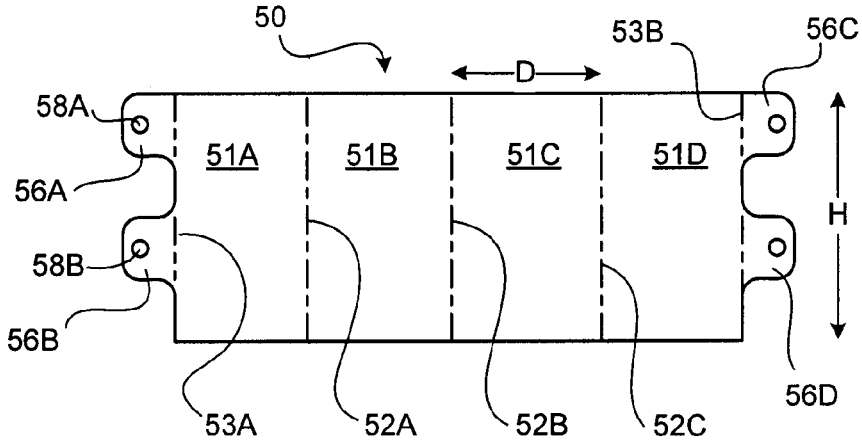
FIG. 11 is a plan view of the starting material used in the construction of a socket portion of the first embodiment of the invention.

The blade portion 41 of embodiment 40 is made from two pieces of metal, each having been cut as shown in FIG. 10. Stamping of reinforcement lines 46, 47 on the blades 42 may occur before, after or contemporaneously with the cutting of the blade material. The material is then bent at a substantially perpendicular angle along fold line 43 to form two blades 42A and 42B. This is repeated for a second piece of blade material which is folded to form two blades 42C and 42D along fold line 44. The two pieces of blade material may then be welded together along join 45. Welding may be applied in 2, 3, 4 or more discrete portions of the join 45, or it may be applied along the entire join.

The welds may comprise spot welds. In certain embodiments, regular welds are applied at the top and bottom of the join 45 and spot welds are applied in 1, 2, 3, 4, 5, or more positions along join 45.

To facilitate the welding process, discrete apertures may be cut along fold lines 43 and 44. The discrete apertures can coincide with the portions to be welded so that the weld may be applied from a single side of the blades.

If the outer edges of the blades are bent due to the stamping of reinforcement lines, the edge of the blades may be straightened, such as by mechanical straightening. This can occur before or after the bending of the blade material.

In alternate embodiments, the blade portion may be constructed without folding by welding individual blade pieces together along join 45.

The post supporting socket portion 50 comprises four side walls 51 that are in a substantially perpendicular arrangement to each other. Reinforcement lines 55 may be stamped or otherwise marked in each side wall 51. The reinforcement lines 55 may be concentrated on the lower portion of the socket portion 50, or may extend further up the side walls 51. One, two, three, or more reinforcement lines 55 may be applied to each side wall 51.

Figure 17:
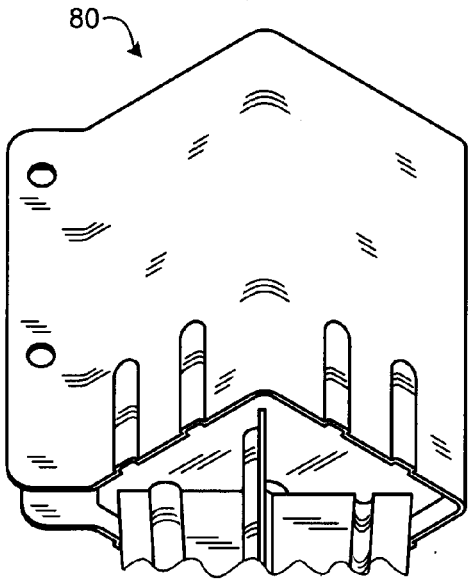
FIG. 17 is a perspective view of the socket portion of the second embodiment of the invention.
Figure 18:
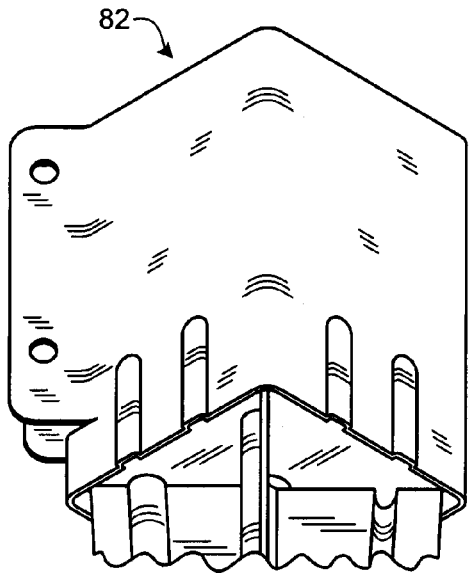
FIG. 18 is a perspective view of the socket portion of a third embodiment of the invention.
Figure 19:
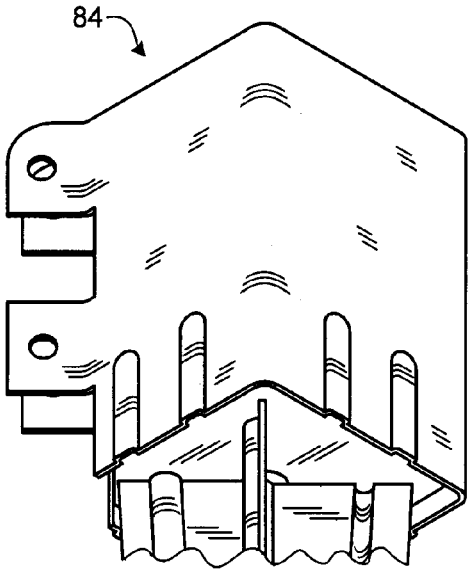
FIG. 19 is a perspective view of the socket portion of a fourth embodiment of the invention.
Figure 20:
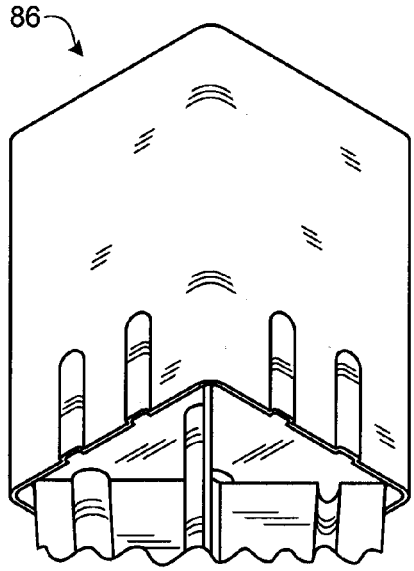
FIG. 20 is a perspective view of the socket portion of a fifth embodiment of the invention.
Figure 21:
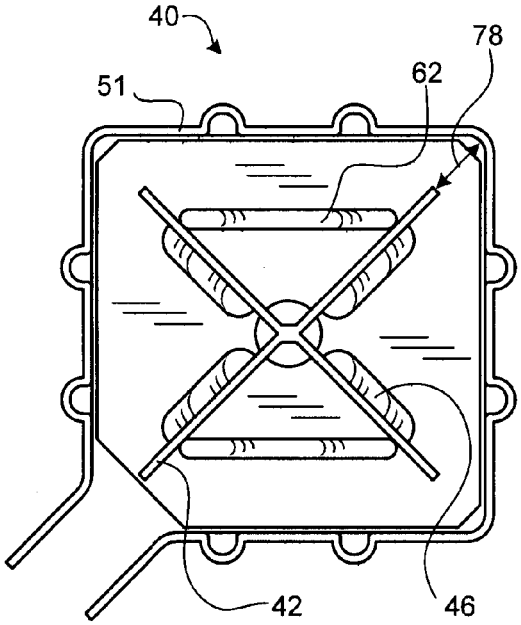
FIG. 21 is a bottom view of the first embodiment of the invention.
Figure 22:
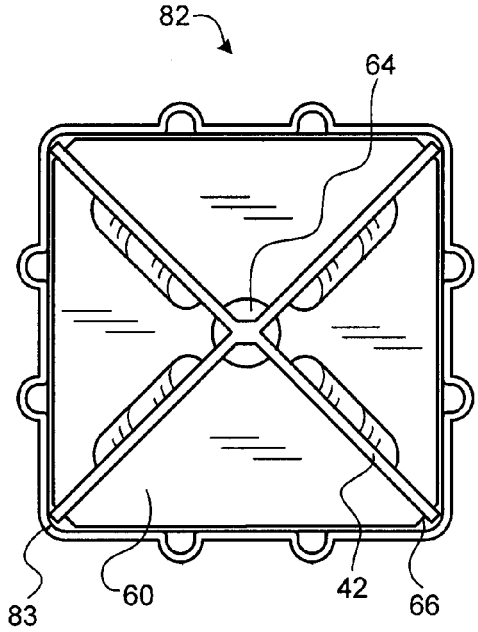
FIG. 22 is a bottom view of the fifth embodiment of the invention.
Figure 23:
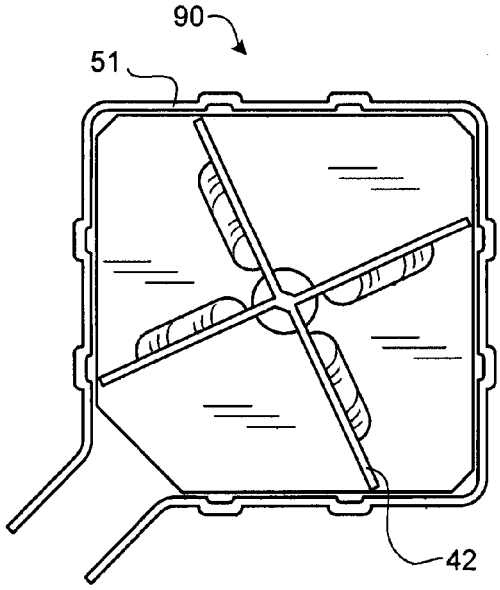
FIG. 23 is a bottom view of a sixth embodiment of the invention.
Figure 24:
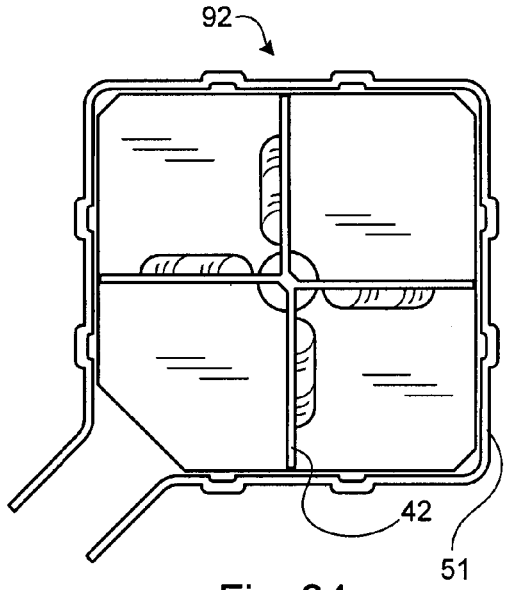
FIG. 24 is a bottom view of a seventh embodiment of the invention.
Figure 25:
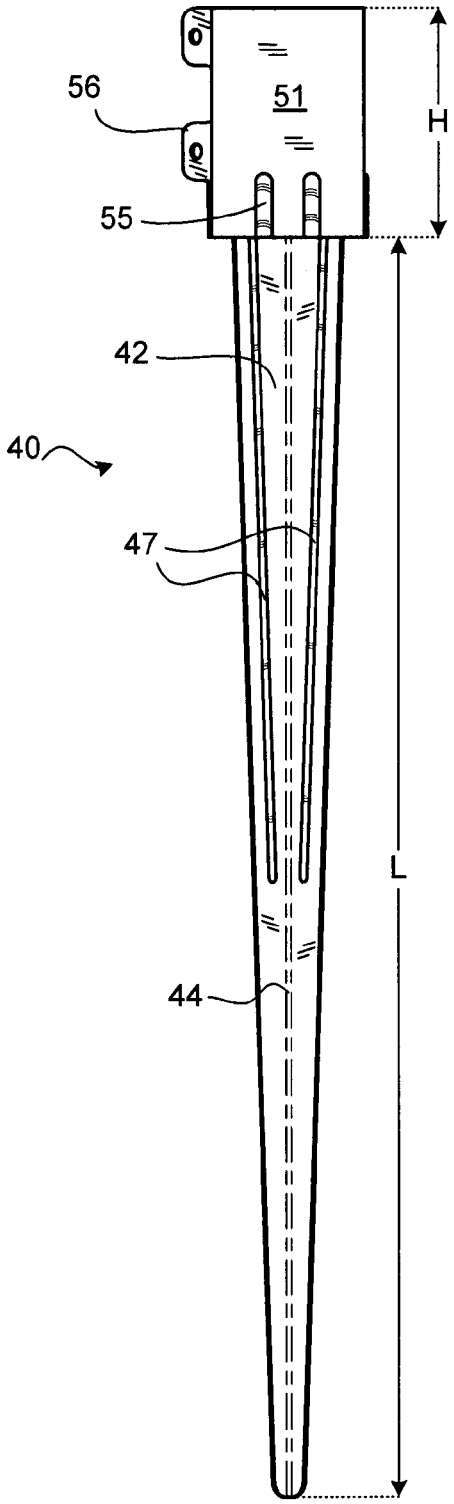
FIG. 25 is a side view of the first embodiment of the invention.

Clamping tabs 56 may be provided on one or more corners of the socket portion 50. The clamping tabs may take one of various forms known in the art. Examples of differently shaped clamping mechanisms can be seen with reference to embodiments 80, 82, and 84 shown in FIGS. 17-19. Clamping tabs have apertures 58 to allow a bolt to pass therethrough for tightening the socket portion 50 on a post placed therein during installation. Clamping tabs may have one, two, three, or more apertures 58 to allow various numbers of bolts to secure the socket portion 50 to a post.

Figure 13:
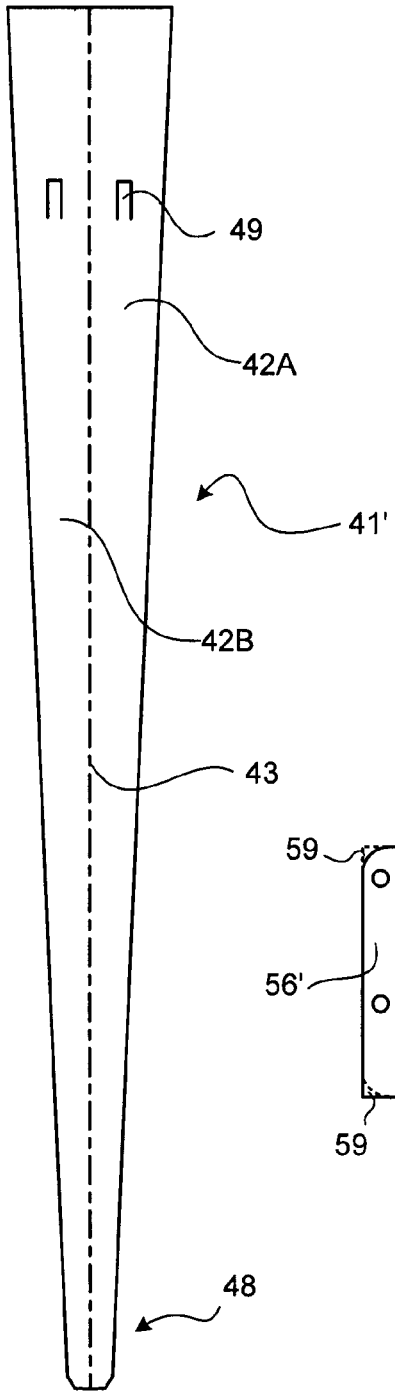
FIG. 13 is a plan view of a segment of a blade portion used in the construction of a second embodiment of the invention.

A ground spike according to the present invention may comprise a web, wherein the web may comprise a base plate 60. Base plate 60 is preferably formed of a unitary piece of metal to be secured to each of the four sides of the socket portion 50. As shown in FIG. 13, socket base plate 60 has four main sides 65 that define a square in the approximate dimensions of the inside of the socket portion 50. Each of the four corners of the square may be cut out. Socket base plate 60 has three removed corners 66 of equal size, and a larger removed corner 68 to correspond with the corner in which the clamping tabs 56 are located in embodiment 40. Socket base plate 60 may have a central aperture 64. The central aperture 64 and the cut-out corners 66 may assist in the drainage of water or liquids when in use, and may assist in powder coating or painting during manufacture.

Reinforcement lines 62 may be stamped into socket base plate 60 for increased strength and rigidity, which may increase the resistance of the base plate 60 to torsion forces.

Once the blade portion 41, the socket portion 50, and the socket base plate 60 have been manufactured as described above, embodiment 40 is further assembled by welding each of the four sides 65 of the socket base plate to a side wall 51 of the socket portion 50. For example, side 65A may be welded to side wall 51A, and side 65B may be welded to side wall 51B, etc. The length of the weld between each side 65 and side wall 51 is almost the entire depth D of each side wall 51.

The length L of the blades may be any suitable length, for example between 40 and 10 inches, or more preferably between 32 and 24 inches. The length of the blades portion 41 may be varied according to the soil conditions of the application.

The width W of the blades may be any suitable length for a given application. Where the application is for supporting a 4×4 post, which is generally 3.5" by 3.5" wide, the inside depth D of each side wall 51 of the socket portion 50 may be slightly more than 3.5". In this case the width W will be the same or less than the distance between opposing sides 65 of the square 61 defined by plate 60 if the blades 42 are welded to the plate 60 at angles parallel to the sides 65. In embodiments where the blades 42 are parallel to the sides 65, width W will be between 3.5" and 2.5", and more preferably between 3.5" and 3", and most preferably between 3.5" and 3.3". In embodiments where the blades 42 are welded to the plate 60 at approximately 45 degree angles to the sides 65 (i.e. the top surface of the blades extend towards the corners of square 61), then width W must be the same or less than the length of a diagonal line that would extend from corner to opposite corner of the square 61. For supporting a 4×4 post that is 3.5" by 3.5" wide, the diagonal line 69 extending between opposite corners of square 61 may be about 5". For embodiments with blades welded to plate 60 generally along diagonal line 69, the width W will be between 5" and 2.5", preferably between 5" and 4" and more preferably between 4.9" and 4.5".

The blades taper from the top to the bottom, such that the width T at the tip of the blades is significantly less than the width W at the top of the blade portion.

It is noted that the width W, which is illustrated in FIG. 10 as being the width of the piece of material that is bent to form blades 42A and 42B, is approximately the same as the width of the top portion of the assembled blade portion 41. Similarly the width T illustrated in FIG. 10 is generally the same as the width of the tip portion 48 of the assembled blade portion 41. Although in practice these widths may vary, particularly due to variations in the curvature of bends 43 and 44 and in the welds joint 45, for ease of reference in this section widths W and T are treated as equivalent and therefore reference to one of these widths may be applied to either width value.

Figure 15:
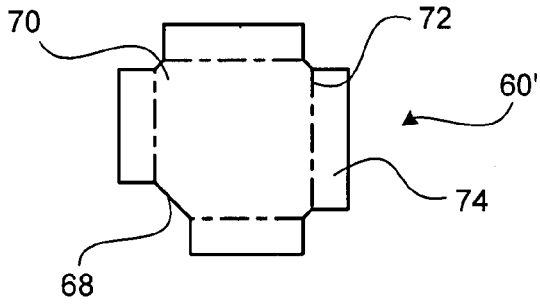
FIG. 15 is a plan view of the starting material used in the construction of a base plate of the second embodiment of the invention.
Figure 14:
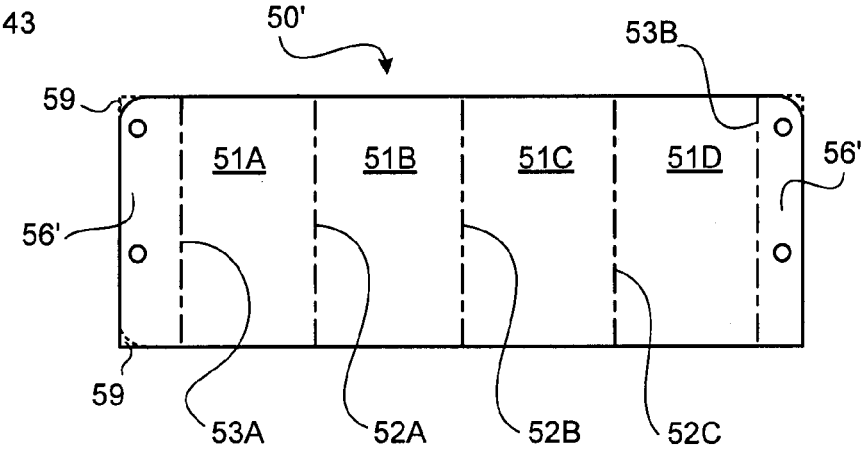
FIG. 14 is a plan view of the starting material used in the construction of a socket portion of the second embodiment of the invention.

Height H of the socket portion 50 may be any suitable height. If height H is too high, the post support will not be suitable for constructing certain fences because dogs, raccoons or other animals may fit under the fence. For 4×4 post installations, height H may be between 6.5" to 4" or more preferably between 4.75" and 5.75", and most preferably between 5" and 5.5". FIGS. 13-15 show examples of alternate embodiments of the blade portion 41', the socket portion 50' and the plate 60'. Blade portion 41' has cut outs 49 which protrude from one side of the blade. Other alterations to the surface of the blades, including stamped out portions or alternative reinforcement mechanisms are understood to fall within the scope of the invention. The blade tip 48 may be of any suitable shape, including having a rounded end as shown in FIG. 10, having tips cut off as shown in FIG. 13, or with the tips square (not shown).

Plate 60' has tabs 74 that may be folded perpendicular to the flat surface 70 along lines 72. Plate 60' may be welded to the side walls 51 of the socket portion 50 along one or both of the fold line 72 and the outer edge of tab 74.

Socket portion 50' shows alternate embodiments for clamping tabs 56' in which the entire tab, that may have two apertures 58, remains as a single piece of material. The corners 59 of the clamping tabs 56' may or may not be removed. Rounded corners may increase the safety of handling the ground spike.

Figure 16:
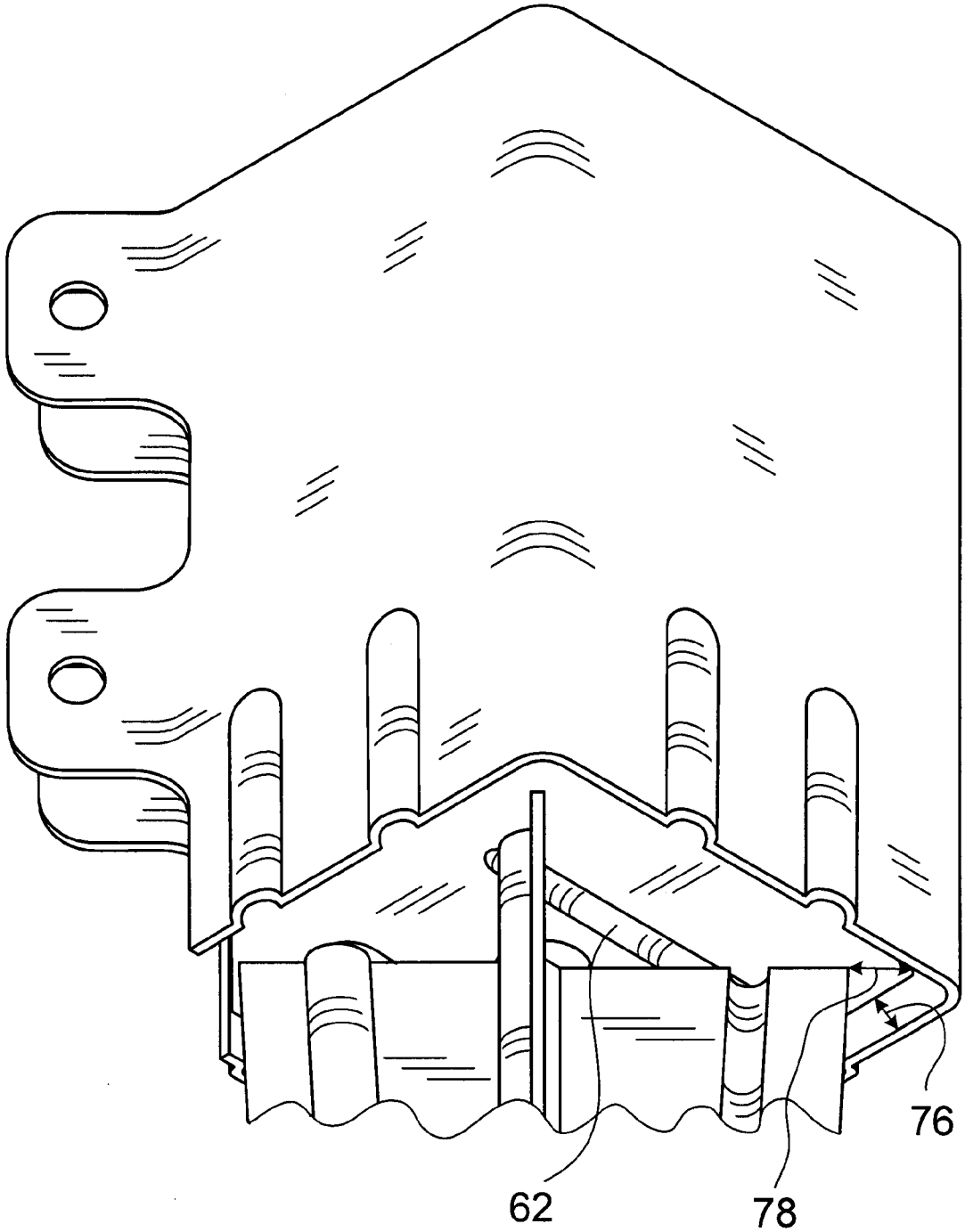
FIG. 16 is an enlarged perspective view of the socket portion of the first embodiment of the invention.

FIG. 16 shows an enlarged perspective view of the underside of the socket portion 50 of embodiment 40. Plate 60 is welded a distance 76 away from the lower edge of the side walls 51. Distance 76 may be between 30 mm and 0 mm, preferably between 15 mm and 2 mm, and more preferably between 10 mm and 3 mm. One consideration in choosing a suitable distance 76 may be the distance that can be filled entirely with weld material.

Width W of the blade portion 41 may be varied to fit on plate 60. The distance 78 between the closest top edge corner of the blade portion 41 and the side wall 51 (measured along a line that continues in the plane of the blade) may be between 0 mm and 40 mm, preferably between 0 mm and 25 mm, and more preferably between 0 mm and 15 mm.

Although various clamping mechanisms have been described, embodiment 86 illustrates a post support with no clamping mechanism. The side walls can be welded together to form a join in place of the clamping mechanism.

Different orientations of the blades can be seen with reference to FIGS. 21-24. Embodiments 40 and 82 show an X-shaped design wherein the blades extend towards the corners of the socket. Embodiment 92 shows a +-shaped cross-section where the blades extend towards the mid sections of the walls 51. Embodiment 90 shows an orientation of the blades that is intermediate between the X-shape and the +-shape cross-sections. The distance 78 can be varied, such as from approximately 0 mm shown in embodiment 82 to between 5 and 25 mm shown in embodiment 40.

Embodiment 40 has two reinforcement lines on the plate 60, whereas embodiments 82, 90 and 92 do not have reinforcement lines on the plate.

Figure 26:
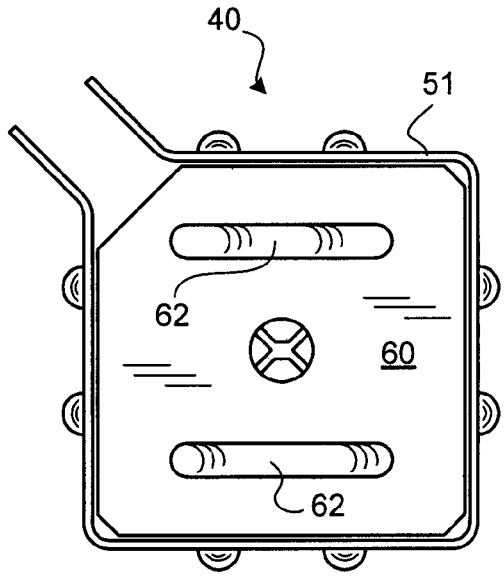
FIG. 26 is a top view of the first embodiment of the invention.
Figure 27:
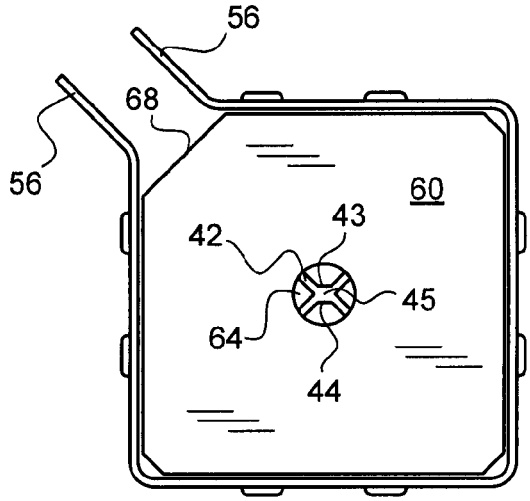
FIG. 27 is a top view of the second embodiment of the invention.

Top views of alternate embodiments are shown in FIGS. 26 and 27. The corners and aperture 64 that may be cut from the plate 60 may allow drainage of powder during powder coating and may allow drainage of fluid after installation.

Figure 28:
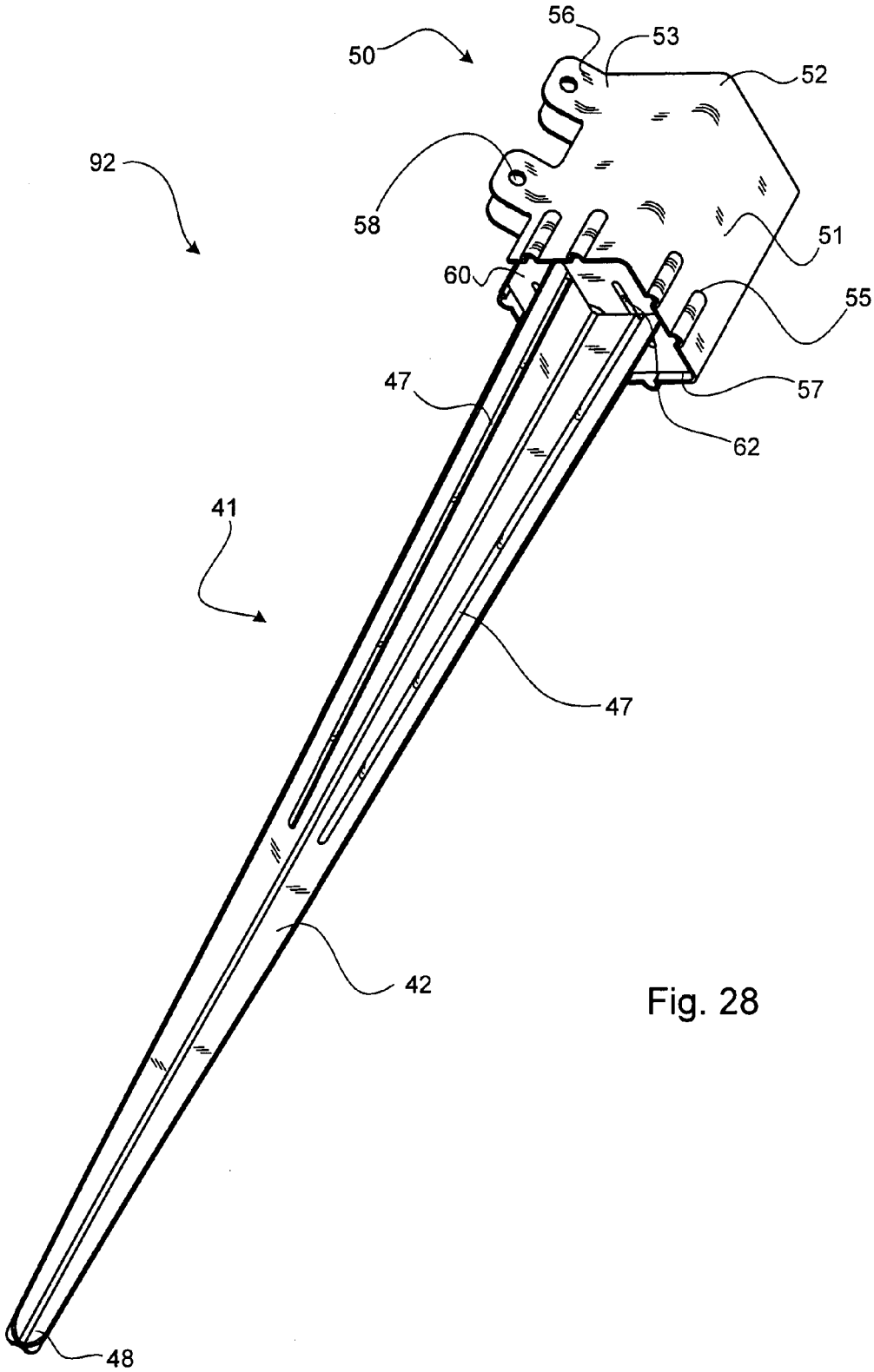
FIG. 28 is a perspective view of the seventh embodiment of the invention.
Figure 29:
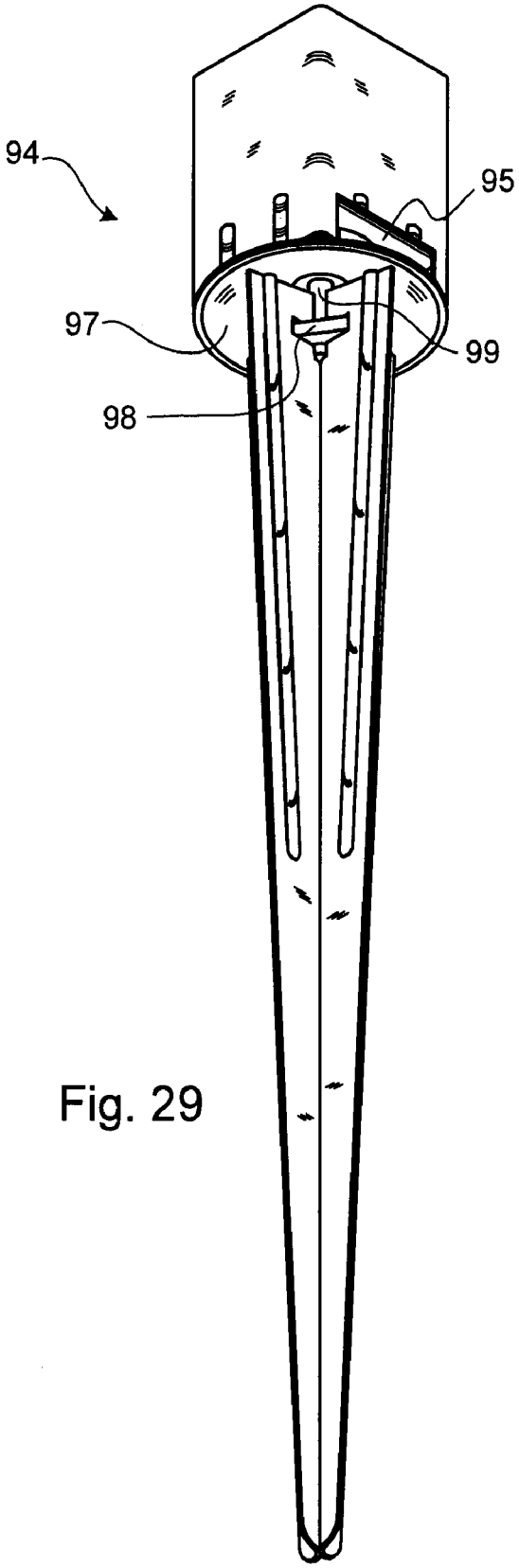
FIG. 29 is a perspective view of an eighth embodiment of the invention.
Figure 30:
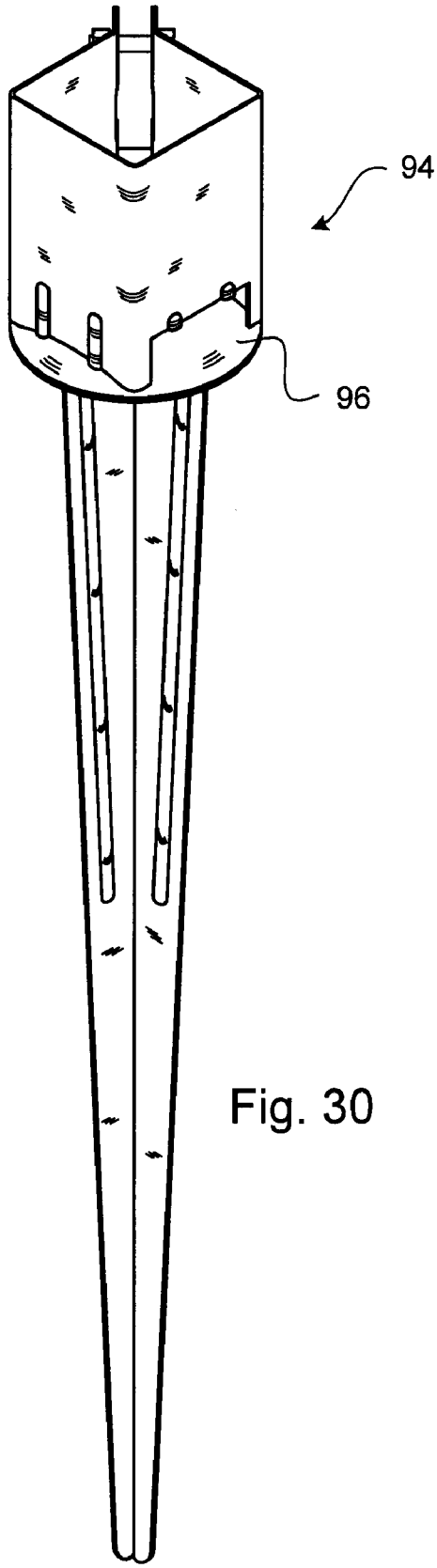
FIG. 30 is a second perspective view of the eighth embodiment of the invention.
Figure 31:
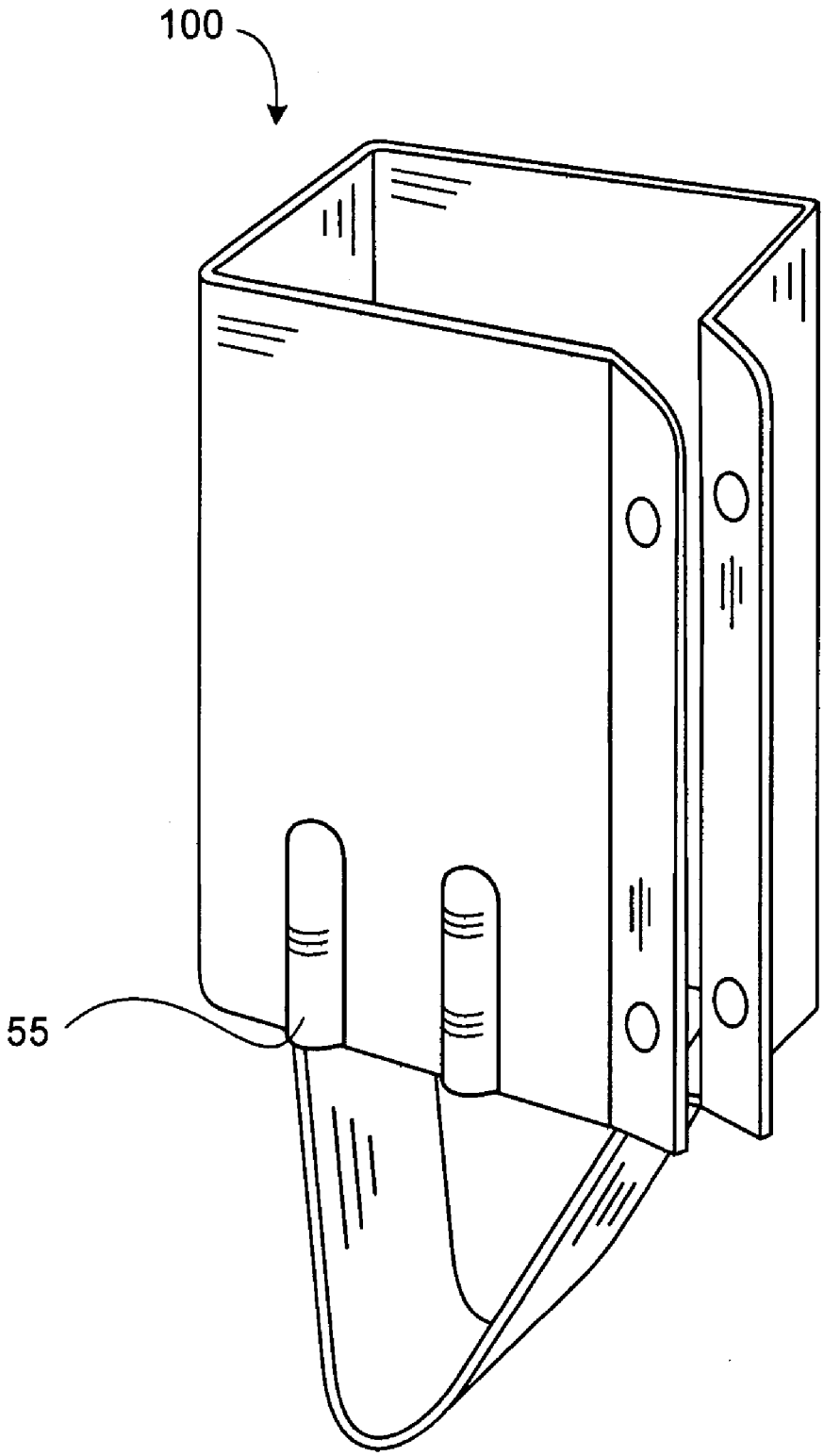
FIG. 31 is a perspective view of a ninth embodiment of the invention.
Figure 32:
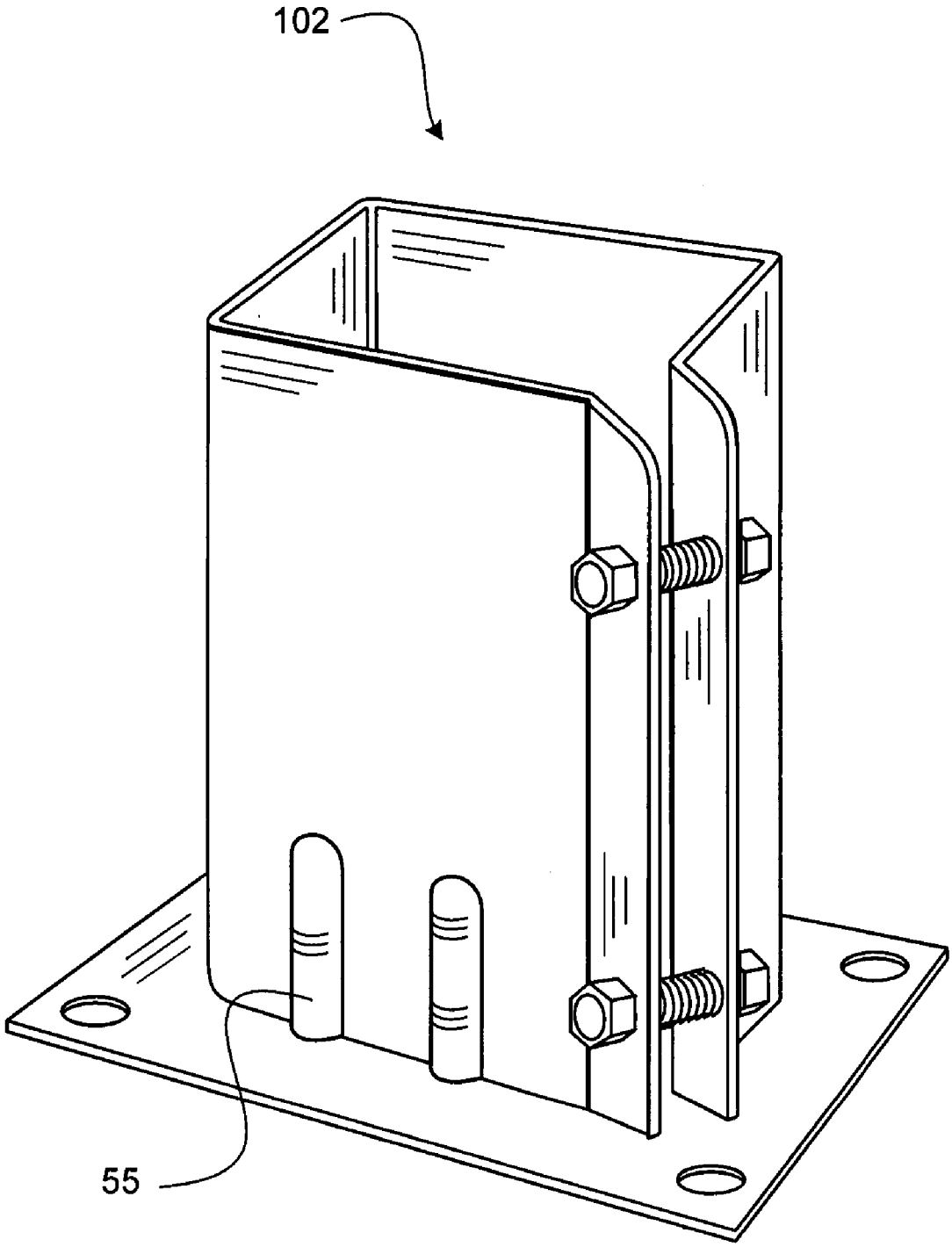
FIG. 32 is a perspective view of a tenth embodiment of the invention.
Figure 33:
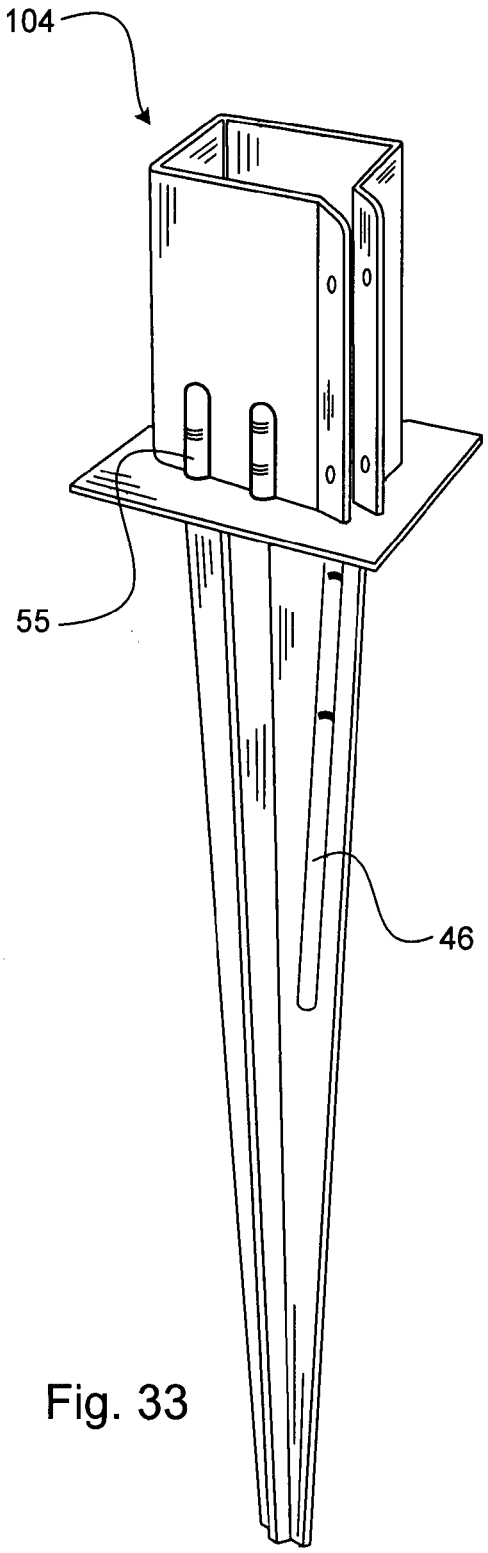
FIG. 33 is a perspective view of an eleventh embodiment of the invention.
Figure 34:
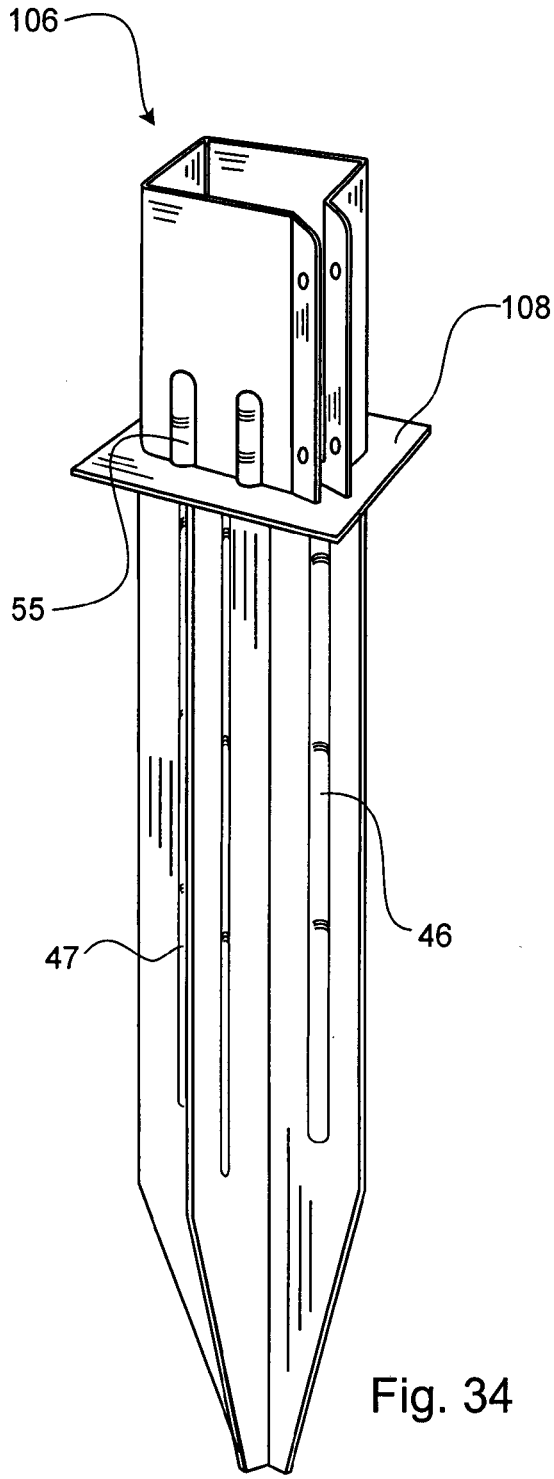
FIG. 34 is a perspective view of a twelfth embodiment of the invention.

Embodiment 92 shown in FIG. 28 has the blade portion 41 oriented 90 degrees from the orientation shown in embodiment 40.

Embodiment 94 is an adjustable ground spike, having two domes 96 and 97 sitting in place of the base plate 60. A bolt 99 and nut 98 arrangement allows adjustment of the orientation of the socket from the blades portion during installation. This may be advantageous during installation, particularly if the blades are not driven into the ground straight. The socket may have an opening 95 to allow access by a wrench or other device to adjust and tighten the head of the bolt during installation. Domes 96 and 97 may be any suitable thickness, such as between 3.0 mm and 9.0 mm, and more preferably between 5.0 mm and 7.5 mm. The domes 96 and 97 may be stamped with reinforcement lines, whether concentric circles or lines that radiate outward. Reinforcement lines can be stamped in the blades and in the socket.

Embodiment 100 is an example of a post support that could be set in concrete. This type of post support does not require a blade portion. However the socket 50 and the plate 60 could be constructed in the same manner.

Embodiment 102 is an example of a post support that can be bolted down to a surface, such as a concrete surface or a wooden deck. The socket may be constructed as in embodiment 40. The plate may extend outward beyond the socket walls.

Embodiments 104 and 106 are examples of post supports having plates 108 that extend outward beyond the socket walls. Embodiment 106 also shows an alternate pattern for the construction of the blade elements. Reinforcement lines can be placed in some or all of the blades, socket and plate 108 in embodiments 104 and 106.

Post support ground spikes are installed by placing a short post segment into the post socket, then hammering the post segment, which in turn drives the post support into the ground. No digging or mixing concrete is involved.

Different portions of the ground spike may be made of different types of metal, whether that be different alloys, different coatings on the metal, different treatments of the metal, and/or different thicknesses of metal. Early test results of the invention indicate that the portion of the ground spike that requires the thickest and/or strongest material is the base plate 60. Test results further indicate that the portion of the ground spike that requires the least strength and/or may permit the least thickness is the socket portion 50, with the blade portion 41 requiring an intermediate strength and/or thickness of metal.

Test results also indicate that the socket portion 50 requires the most strength at and near the weld to the base plate 60. For this reason, the reinforcement lines 55 in embodiment 40 only appear at or near the area in which the side walls 51 are welded to the base plate 60. The reinforcement lines 55 may be raised slightly above the area in which the base plate 60 is welded so that there is no gap in the weld between the plate 60 and the side walls 51.

The top one to two thirds of the blade portion require the most rigidity and the most resistance to torsion. The tips of the blades 48 also must be relatively strong to avoid distortion when hitting rocks or other hard items when driven into the ground.

It is possible to weld additional pieces onto the blades, below the reinforcement lines, to add extra rigidity to the blade portion. This may be particularly useful when trying to minimize the thickness of the blades and yet are unable to stamp suitable reinforcement lines in certain sections of the blades, or where certain portions of the blades require extra reinforcement.

In alternate embodiments, reinforcement lines may be added, where practicable, to any portion of the ground spike without departing from the invention. The nature and pattern of the reinforcement lines, as well as the thickness of the lines and the depths of the contours may be varied.

It is to be understood that base plate 60 may be referred to as a web, which is a broader term. The term web may encompass base plate 60 alone or in conjunction with any other portion of the ground spike connected to base plate 60.

It will be appreciated by those skilled in the art that the first and second embodiments have been described above in some detail but that certain modifications may be practiced without departing from the principles of the invention.

What is claimed is:

1. A post support, comprising:

a socket having four substantially perpendicular socket walls;

a web, the web welded to the socket along a plurality of said substantially perpendicular socket walls, at an elevated distance away from a lower edge of said walls, wherein the web is welded to the socket along the four substantially perpendicular socket walls, and wherein the web extends in a plane and said substantially perpendicular socket walls extend normal to said plane;

the socket comprising reinforcement lines, wherein said reinforcement lines span across where said web is welded to said socket, wherein said reinforcement lines are stamped on each socket wall and protrude outwardly from said socket, and wherein said reinforcement lines are vertical reinforcement lines that extend normal to the plane of the web; and wherein the socket is a unitary piece of material, folded to form said four substantially perpendicular socket walls.

2. The post support of claim 1 wherein the socket is a unitary piece of material, folded to form said set of opposing clamping tabs.

3. The post support of claim 2 comprising a second set of opposing clamping tabs.

4. A post support comprising:

a socket having four substantially perpendicular socket walls;

a web, the web welded to the socket along a plurality of said substantially perpendicular socket walls, at an elevated distance away from a lower edge of said walls, wherein the web is welded to the socket along the four substantially perpendicular socket walls;

a blade portion welded to the web, the blade portion comprising a plurality of blades;

the socket comprising reinforcement lines, wherein said reinforcement lines span across where said web is welded to said socket, wherein said reinforcement lines are stamped on each socket wall and protrude outwardly from said socket.

5. The post support of claim 4 wherein the blade portion comprises four blades.

6. The post support of claim 4 wherein the blade portion comprises three blades.

7. The post support of claim 5 wherein each of the four blades has a reinforcement line stamped therein.

8. The post support of claim 7 wherein the four blades are secured in a substantially perpendicular arrangement.

9. The post support of claim 8 wherein the four blades comprise two sets of material, each set of material folded to form two blades, the two sets welded together at a join.

10. The post support of claim 9 wherein said elevated distance is between 1 mm and 20 mm.

11. The post support of claim 9 wherein said elevated distance is between 2 mm and 10 mm.

12. The post support of claim 9 wherein said elevated distance is between 2.5 mm and 7 mm.

13. The post support of claim 10 wherein said socket, said blades portion and said web each comprise steel having a thickness between 1.3 mm and 3.5 mm.

14. The post support of claim 10 wherein said socket, said blades portion and said web each comprise steel of between 1.5 mm and 2.5 mm.

15. The post support of claim 10 wherein said socket and said blades portion each comprise steel of between 1.5 mm and 2.5 mm and said web comprises steel of between 2.0 mm and 3.5 mm.

16. The post support of claim 10 wherein said socket and said blades portion are a different thickness of metal from said web.

17. The post support of claim 10 wherein each of said socket, said blades portion, and said web comprise different thicknesses of metal.

18. The post support of claim 10 wherein said socket and said blades portion each comprise steel of between 1.7 mm and 1.9 mm and said web comprises steel of between 2.3 mm and 2.7 mm.

19. The post support of claim 10 wherein said socket and said blades portion each comprise steel of between 1.8 mm and said web comprises steel of between 2.5 mm.

20. The post support of claim 15 wherein the web comprises a plurality of reinforcement lines stamped therein.

21. The post support of claim 15 wherein the four blades are oriented in an X cross-section, the blades having upper outer edges extending towards corners of the substantially perpendicular socket walls.

22. The post support of claim 15 wherein the four blades are oriented in a + cross-section, the blades having upper outer edges extending towards the mid sections of said four substantially perpendicular socket walls.

23. The post support of claim 21 wherein the upper outer edges are welded to the corners of the substantially perpendicular socket walls.

24. The post support of claim 22 wherein the upper outer edges are welded to the mid sections of the substantially perpendicular socket walls.

* * * * *

UNITED STATES PATENT AND TRADEMARK OFFICE

CERTIFICATE OF CORRECTION

PATENT NO. : 8,322,678 B2
APPLICATION NO. : 12/445276
DATED : December 4, 2012
INVENTOR(S) : Jianzhong Zhu and Simon Walker It is certified that error appears in the above-identified patent and that said Letters Patent is hereby corrected as shown below:

In the Claims:

Column 7, line 66, the portion of claim 2 reading "said set" should read --a set--

Column 8, lines 60 to 61, in claim 19, the word "between" immediately before "1.8 mm" and immediately before "2.5 mm" should be deleted Signed and Sealed this
Seventeenth Day of December, 2013

Margaret A. Focarino

Margaret A. Focarino
*Commissioner for Patents of the United States Patent and Trademark Office*